US009611850B2

(12) United States Patent
Weigl et al.

(10) Patent No.: US 9,611,850 B2
(45) Date of Patent: Apr. 4, 2017

(54) METHOD AND DEVICE FOR FIXING AND SYNCHRONIZING ROTARY PISTONS IN A ROTARY PISTON PUMP

(71) Applicant: NETZSCH Pumpen & Systeme GmbH, Selb (DE)

(72) Inventors: Stefan Weigl, Muehldorf am Inn (DE); Reinhard Denk, Muehldorf (DE); Hish am Kamal, Waldkraiburg (DE); Josef Strassl, Straubing (DE); Robert Kurz, Aschheim (DE); Bernhard Murrenhoff, Buchbach (DE); Thomas Boehme, Waldkraiburg (DE); Gunther Herr, Haarth (DE); Franz Kneidl, Waldkraiburg (DE); Mikael Tekneyan, Waldkraiburg (DE); Matthias Gradl, Sesslach (DE); Erwin Weber, Ampfing (DE); Roger Willis, Mettenheim (DE); Stefan Kern, Haag (DE); Johann Kreidl, Waldkraiburg (DE); Marcel Verhoeven, Hailsham East Sussex (GB)

(73) Assignee: NETZSCH Pumpen & Systeme GmbH, Selb (DE)

( * ) Notice: Subject to any disclaimer, the term of this patent is extended or adjusted under 35 U.S.C. 154(b) by 30 days.

(21) Appl. No.: 14/453,264

(22) Filed: Aug. 6, 2014

(65) Prior Publication Data

US 2014/0345451 A1 Nov. 27, 2014

Related U.S. Application Data

(63) Continuation of application No. PCT/DE2013/100056, filed on Feb. 14, 2013.

(30) Foreign Application Priority Data

Feb. 17, 2012 (DE) ..... 10 2012 003 066

(51) Int. Cl.
*B23P 15/00* (2006.01)
*B23P 6/00* (2006.01)
(Continued)

(52) U.S. Cl.
CPC ..... *F04C 27/005* (2013.01); *F04C 2/00* (2013.01); *F04C 2/12* (2013.01); *F04C 15/0026* (2013.01);
(Continued)

(58) Field of Classification Search
CPC ..... Y10T 29/49231; Y10T 29/49238; F04C 27/005; F04C 2/00; F04C 2/12;
(Continued)

(56) References Cited

U.S. PATENT DOCUMENTS 2,044,930 A * 6/1936 Zubaty ..... F16D 23/04 192/107 M
3,105,634 A 10/1963 Hubrich
(Continued)

FOREIGN PATENT DOCUMENTS

DE 19756838 C1 4/1999
DE 19806657 A1 9/1999
WO 2010021549 A1 2/2010

OTHER PUBLICATIONS

International Search Report Application No. PCT/DE2013/100056 Completed: Feb. 18, 2014; Mailing Date: Feb. 28, 2014 2 pages.

*Primary Examiner* — David Bryant
*Assistant Examiner* — Darrell C Ford
(74) *Attorney, Agent, or Firm* — Whitmyer IP Group LLC

(57) ABSTRACT

A method and a device for fixing and synchronizing rotary pistons in a rotary piston pump involves introducing the rotary pistons into the pump space of the rotary piston pump. A shaft stub of each rotary piston is then pushed through a pump rear wall onto a driveshaft provided for the respective
(Continued)

rotary piston. The rotary pistons are aligned and synchronized in the pump space via a template, the template being fixed detachably to a pump housing. The shaft stubs of the respective rotary piston are connected, after the synchronization, in each case via a clamping device in a friction-locked manner to the respective driveshaft, outside the pump space.

6 Claims, 9 Drawing Sheets

(51) Int. Cl.

| | |
|---|---|
| ***G01B 3/14*** | (2006.01) |
| ***F04C 27/00*** | (2006.01) |
| ***F04C 15/00*** | (2006.01) |
| ***F04C 2/12*** | (2006.01) |
| ***F04C 2/00*** | (2006.01) |

(52) U.S. Cl.
CPC .... *F04C 15/0061* (2013.01); *F04C 2230/601* (2013.01); *F04C 2230/602* (2013.01); *F04C 2230/604* (2013.01); *F04C 2240/20* (2013.01); *Y10T 29/49236* (2015.01); *Y10T 29/53* (2015.01)

(58) Field of Classification Search
CPC ..... F04C 15/0026; F04C 2230/601; F04C 2230/602; F04C 2230/604; F04C 2240/20; B01B 5/24; G01B 5/25
USPC ..... 29/888.02, 888.021; 33/562, 563, 566, 33/605, 613
See application file for complete search history.

(56) References Cited

U.S. PATENT DOCUMENTS

| | | | | |
|---|---|---|---|---|
| 3,620,338 | A * | 11/1971 | Tomita | F16D 23/06 192/108 |
| 6,093,009 | A * | 7/2000 | Jacks, Jr. | F01C 17/02 418/201.1 |
| 8,177,535 | B2 * | 5/2012 | Moldt | F04C 2/16 29/888.021 |
| 9,003,633 | B1 * | 4/2015 | Difante | B25B 21/002 29/525.02 |
| 9,249,861 | B2 * | 2/2016 | Fedosovsky | F16H 1/2863 |
| 2001/0043876 | A1 * | 11/2001 | Mekler | F01C 1/28 418/36 |
| 2003/0044298 | A1 * | 3/2003 | Bhagavatula | F04C 15/0046 418/201.1 |
| 2004/0022646 | A1 * | 2/2004 | Garczorz | C22C 1/0416 417/366 |
| 2007/0036667 | A1 * | 2/2007 | Sterk | F01C 11/004 418/35 |
| 2007/0062482 | A1 * | 3/2007 | Arov | F01C 1/077 123/245 |
| 2008/0038138 | A1 * | 2/2008 | Bishop | F04C 2/126 418/206.2 |
| 2010/0124512 | A1 | 5/2010 | Moldt et al. | |
| 2012/0134865 | A1 * | 5/2012 | Kenlock | F01C 1/084 418/167 |

* cited by examiner

METHOD AND DEVICE FOR FIXING AND SYNCHRONIZING ROTARY PISTONS IN A ROTARY PISTON PUMP

FIELD OF THE INVENTION

The present invention relates to a method and a device for fixing and synchronizing rotary pistons in a rotary piston pump.

BACKGROUND OF THE INVENTION

German patent DE 197 56 838 C1 discloses a rotary piston pump with a plurality of rotary piston pairs disposed on parallel shafts. These rotary pistons rotate free from contact and concentrically in the circular housing sections which form the pump chambers. The rotary pistons are connected non-rotatably by means of tongue-and-groove joints to the respective assigned shaft. For this purpose, a feather key is provided in each case, which engages on the one hand in a shaft keyway and on the other hand in a groove of the rotary piston.

German patent application DE 198 06 657 A1 discloses a rotary pump with a pump housing oval in cross-section, with a pair of rotors engaging into one another and disposed in the housing on two parallel shafts capable of being driven in a rotary manner in opposite directions, said rotors each comprising two or more displacement vanes. The displacement vanes rotate with the rotation of the rotors in a sealing manner adjacent to the inner side of the wall of the pump housing and to the respective other rotor. The rotors can be pulled off in the longitudinal direction of the shafts from the latter when the pump housing is opened, the shafts being coupled with one another by torque transmission means, such as a pair of meshing gear wheels or a chain drive or belt drive. One of the shafts can be connected to a drive motor. The rotor pump according to the invention is characterised in that the torque transmission means are constituted with a coupling which is engaged in the basic state and can be disengaged when required.

SUMMARY OF THE INVENTION

The problem underlying the invention is to provide a method with which the rotary pistons of a rotary piston pump can be fixed and aligned and synchronized in the pump space.

The problem according to the invention is solved by a method for fixing and synchronizing rotary pistons in a rotary piston pump, characterised in that the rotary pistons are introduced into a pump space of the rotary piston pump; a shaft stub of each rotary piston is pushed through a pump rear wall and onto a driveshaft provided for the respective rotary piston; the rotary pistons are aligned and synchronized with a template, the template being fixed detachably to a pump housing and the shaft stubs of the respective rotary piston are connected, after the synchronization, in each case by means of a clamping device in a friction-locked manner to the respective driveshaft outside the pump space.

Further advantageous embodiments can be derived from the features of the dependent claims.

A further problem of the invention relates to a device, with which the rotary pistons can be positioned and synchronized in a rotary piston pump.

This problem is solved by means of a template for positioning and/or synchronizing rotary pistons in a rotary piston pump, characterised in that the template comprises a base body on which a plurality of guides are disposed.

A method for fixing and synchronizing rotary pistons in a rotary piston pump is disclosed. The rotary pistons are introduced into a pump space of the rotary piston pump. A shaft stub of each rotary piston is then pushed through a pump rear wall onto a driveshaft provided for the respective rotary piston. The rotary pistons are aligned and synchronized in the pump space with a template, the template being fixed detachably to a pump housing. The shaft stubs of the respective rotary piston are connected, after the synchronization, in each case by means of a clamping device in a friction-locked manner to the respective driveshaft, outside the pump space.

The connections between the shaft stubs and the driveshafts are sealed in each case by a seal against the pump space. Before the introduction of the rotary pistons into the pump space, the seals are pushed detachably onto the shaft stubs of the rotary pistons and are fixed there.

The template is placed on the rotary pistons by means of guides. The spacing required for the lining of a pump lid after installation of the rotary pistons is simulated by at least two spacers on the inner side of the template and by protrusions on the guides. The required spacing between the rotary pistons and the pump rear wall is adjusted by means of the seals. This takes place by the fact that the seal projects minimally into the pump space.

When not being used, the template is fixed to the pump lid by at least two lugs which are disposed on a base body of the template. These lugs are the same lugs with which the template is fixed to the pump housing during the positioning and synchronization.

Furthermore, a template for positioning and/or synchronizing rotary pistons in a rotary piston pump is disclosed. The template comprises a base body, on which a plurality of guides are disposed. Fixed positions of the rotary pistons can be set with the template.

It is possible with the template to manage both double-vane rotary pistons as well as multi-vane rotary pistons. Furthermore, both flat and helical rotary pistons can be positioned and/or synchronized in the rotary piston pump using the template. This is possible because the guides are constituted as rails or as pins. In the preferred embodiments, rails are described which are positioned on the rotary pistons and guide the latter at the longitudinal sides. Twisting of the rotary pistons is eliminated by this exact guidance. Pins or bolts are preferred for the positioning and synchronization of multi-vane rotary pistons. Still smaller guide rails can also be used, so that twisting during use of the template is also made impossible in the case of multi-vane rotary pistons.

In a preferred embodiment, it is possible to design the guides variable in length, i.e. into the pump. Through the possibility of a change in length, it is then also possible to position and/or synchronize rotary pistons and/or pairs of rotary pistons which are positioned in a second row in the pump space.

The base body of the template comprises at least two lugs, with which the template can be fixed to a pump housing during the positioning and synchronization of the rotary pistons and to a pump lid when not in use.

Rotary pistons for a rotary piston pump are disclosed for use in the method according to the invention, wherein these rotary pistons each have a shaft stump which is connected fixedly to the rotary piston. Before the installation of the rotary piston in a rotary piston pump, a seal is disposed detachably on the shaft stump and fixed there. The seal is a slip ring seal or a stuffing box or a lip seal.

Examples of embodiment of the invention and their advantages will be explained in greater detail below with the aid of the appended figures. The size ratios of the individual elements with respect to one another in the figures do not always correspond to the actual size ratios, since some forms are represented simplified and other forms are represented magnified compared with other elements for the sake of better clarity.

DETAILED DESCRIPTION OF THE INVENTION

Figure 1:
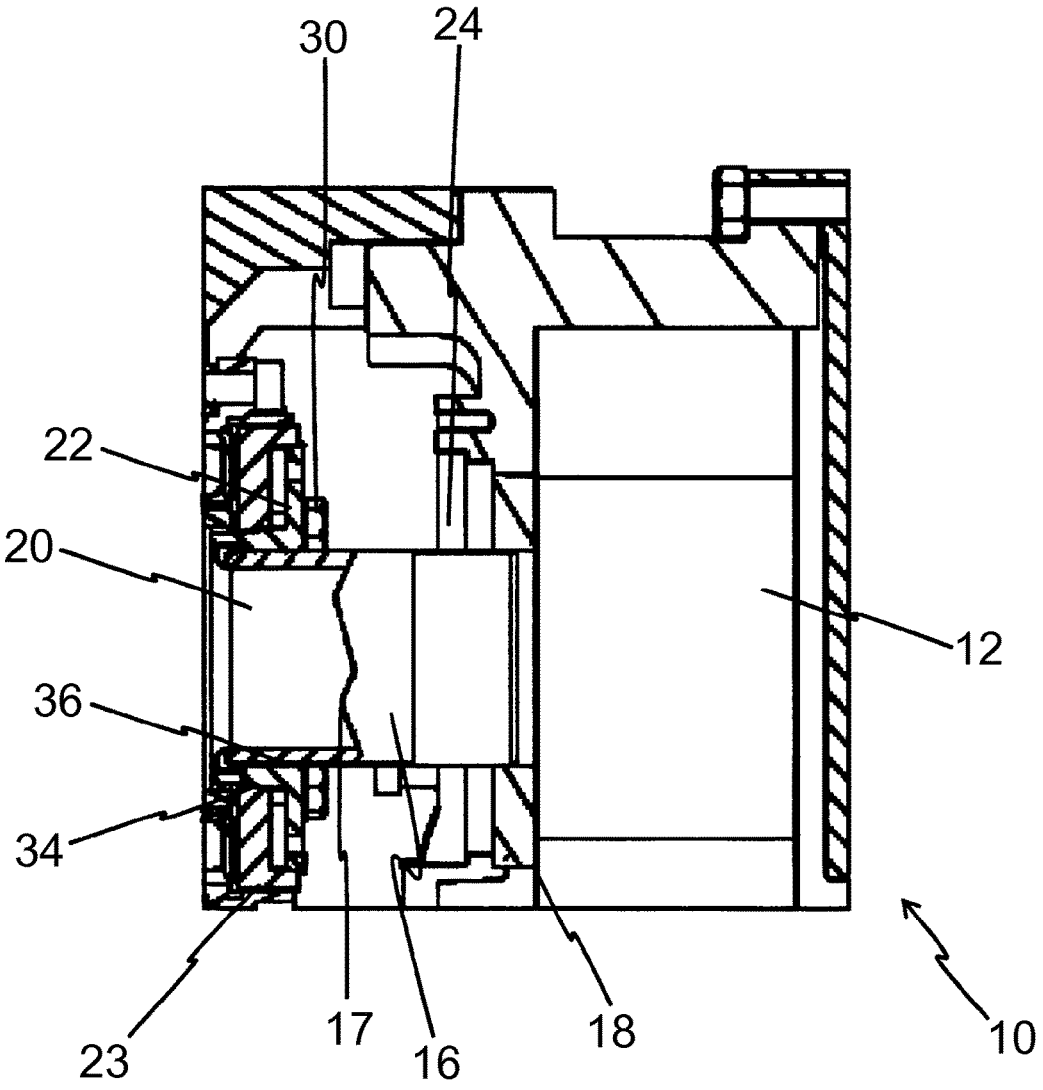
FIG. 1 shows an installed rotary piston according to the invention with a clamping device.

FIG. 1 shows an installed rotary piston 12 according to the invention with a clamping device 22. Rotary piston 12 is disposed in pump space 14 of rotary piston pump 10. A shaft stump 16 is disposed on the side of rotary piston 12 facing pump rear wall 18. This shaft stub 16 is provided with a seal 24 and is pushed over driveshaft 20. Furthermore, a clamping device 22 is disposed on outer end 17 of shaft stub 16. Shaft stub 16 and driveshaft 20 are connected detachably to one another in a friction-locked manner by means of this clamping device 22. When clamping screws 30 are tightened up, clamping device 22 is pressed into a sleeve 23. As a result of this pressing, clamping device 22 at outer side 34 is pressed against sleeve 23 and at inner side 36 against shaft stub 16. Shaft stub 16 is thereby pressed onto driveshaft 20 and is brought into an active connection with the latter in a friction-locked manner.

Clamping device 22 thus works mechanically via parts with conical faces and, when clamping screws 30 are operated, leads to a reduction in the internal cross-section of the annular components engaging into one another. In the described embodiment, the components are driveshaft 20 and shaft stub 16.

Figure 2:
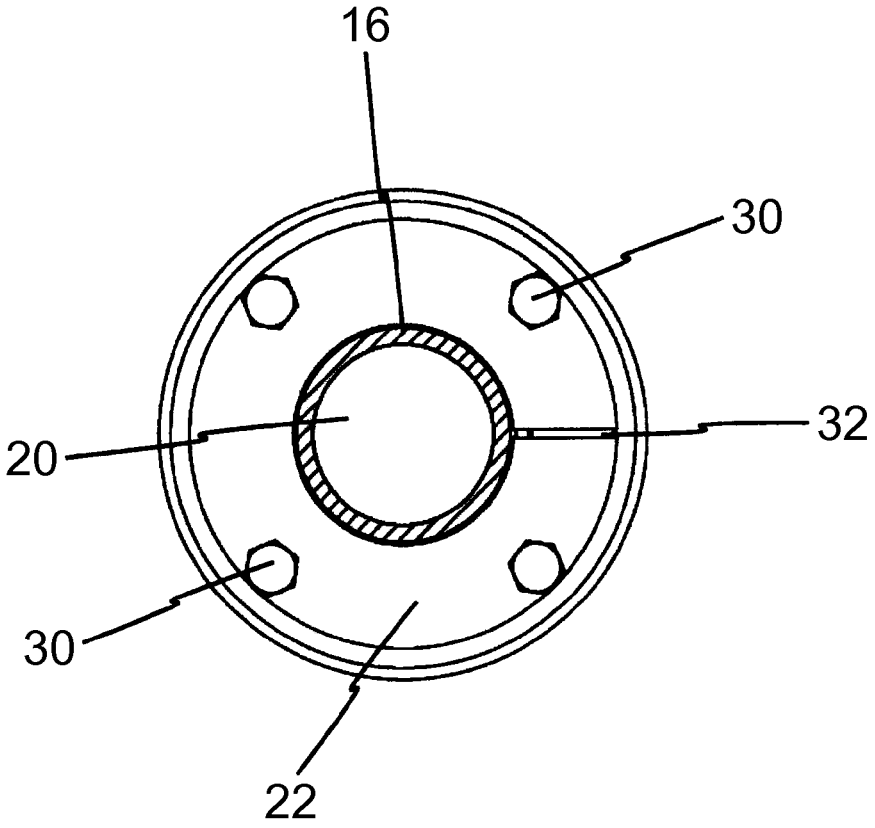
FIG. 2 shows the front view of the connection of the shaft stub and the driveshaft.

FIG. 2 shows the front view of the connection of shaft stub 16 and driveshaft 20. Clamping device 22 is connected via shaft stub 16 of the rotary piston (not represented) to driveshaft 20. Cutout 32 is almost closed as a result of tightening up clamping screws 30, so that shaft stub 16 is pressed onto driveshaft 20 in a friction-locked manner.

Figure 3:
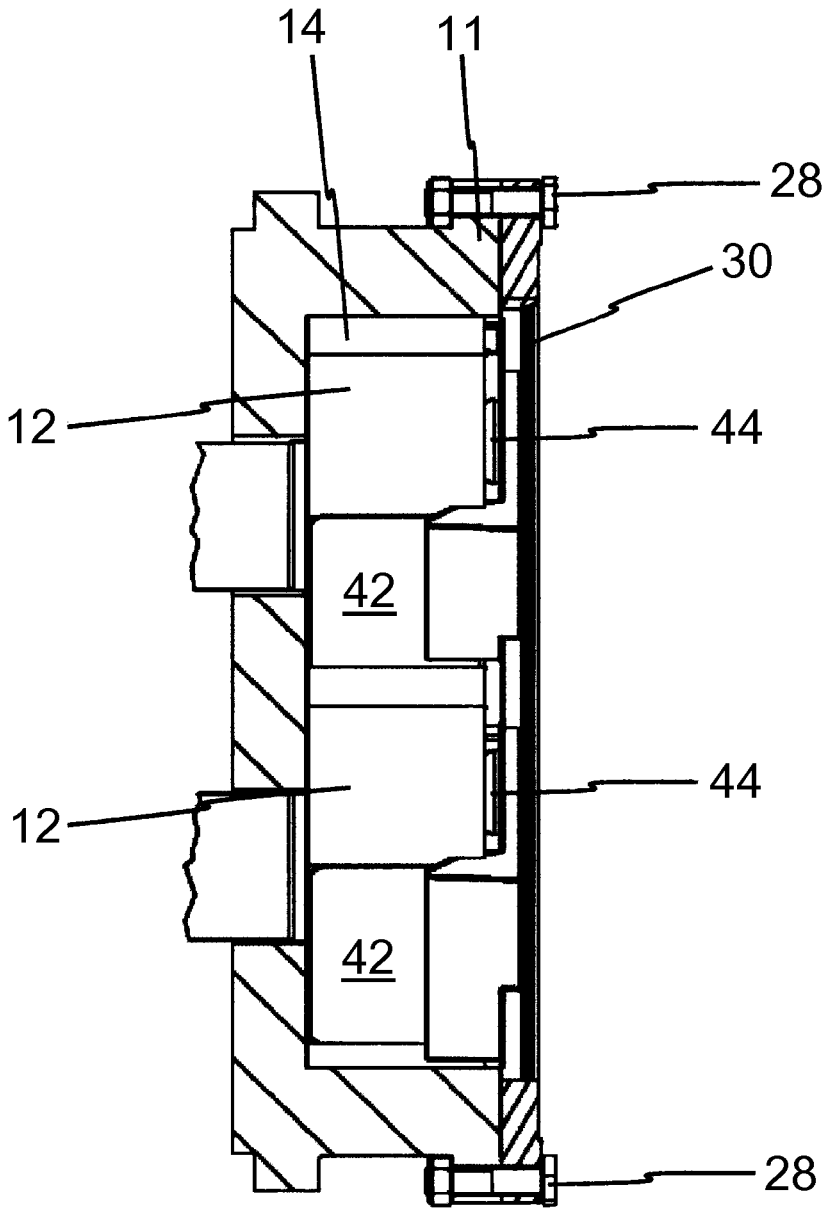
FIG. 3 shows the positioning and synchronization of the rotary pistons with the template.

FIG. 3 shows the positioning and synchronization of rotary pistons 12 with template 40. Rotary pistons 12 can be seen in pump space 14. Template 40 is fixed with screws 28 to pump housing 11. Rotary pistons 12 are positioned and synchronized by means of guides 42. With the aid of spacers 44, the spacing is set that rotary pistons 12 require from the pump lid (not represented) after dismantling of template 40.

Figure 4:
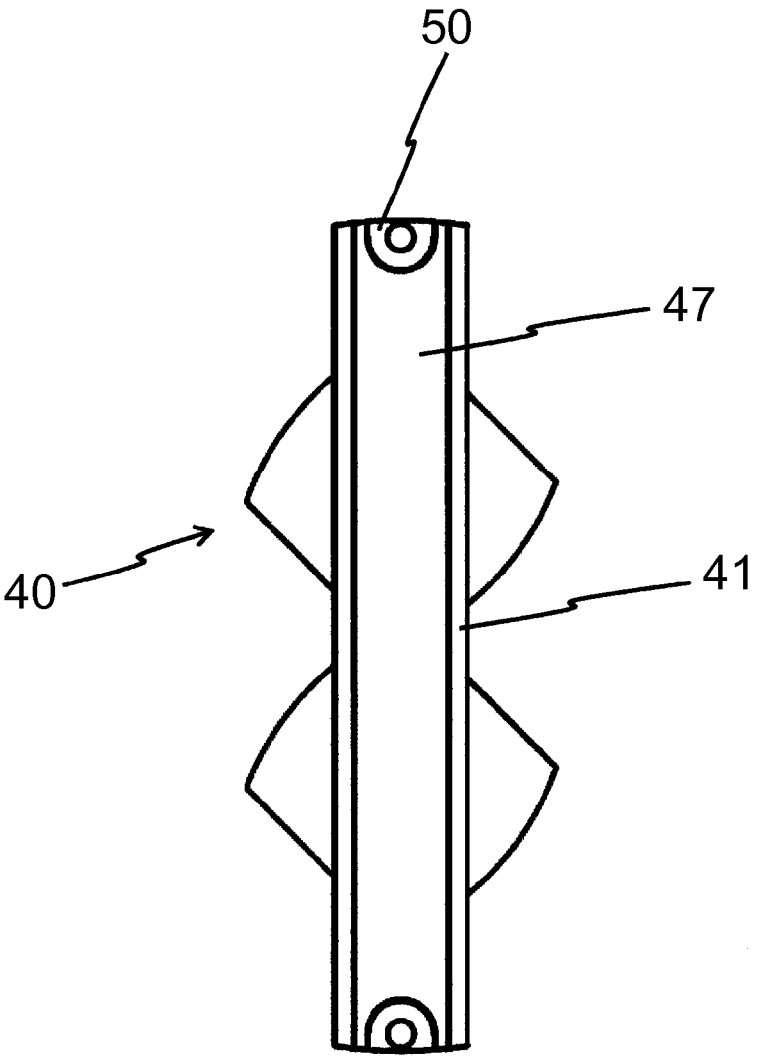
FIGS. 4 and 5 show a template according to the invention.
Figure 5:
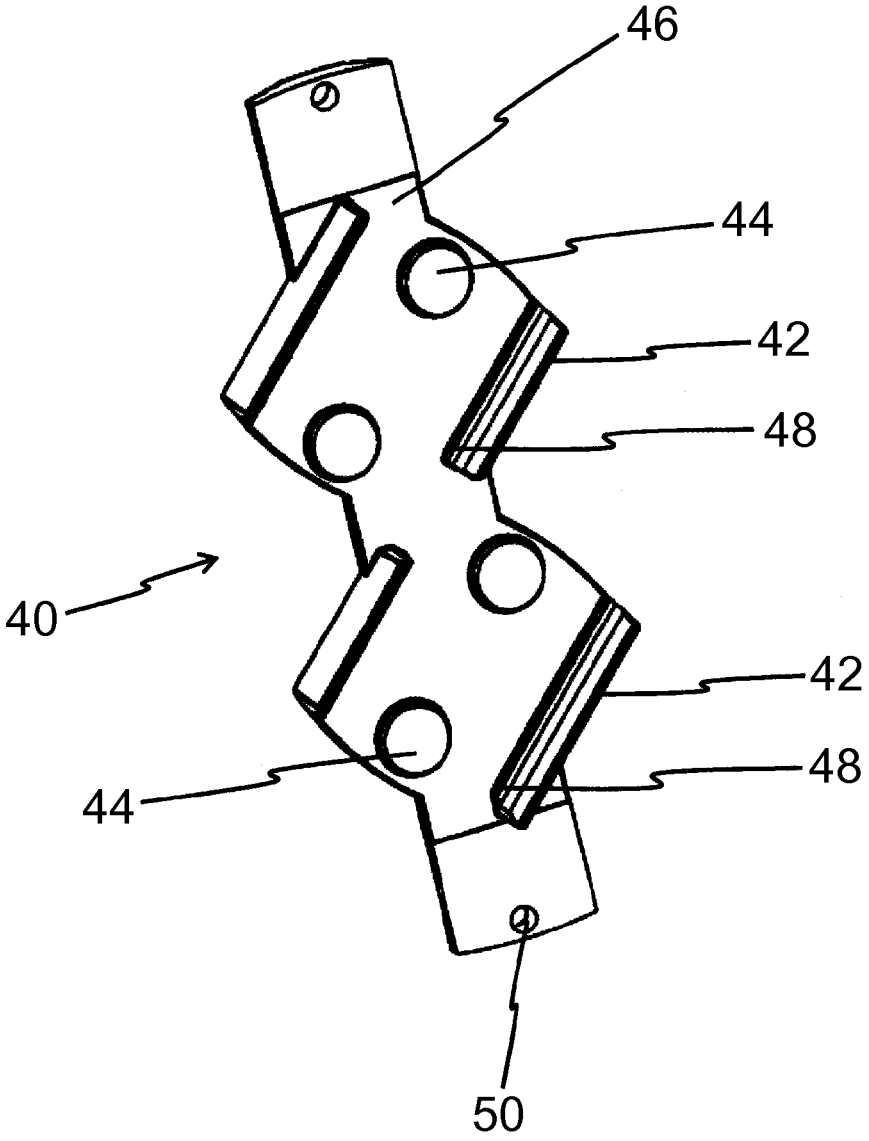

FIGS. 4 and 5 show a template 40 according to the invention. Template 40 comprises a base body 41 which comprises an inner side 46 and an outer side 47. Disposed on outer side 47 are lugs, with which template 40 can be fixed to the pump housing during positioning and synchronization of the rotary pistons (not represented) and to the pump lid when not in use. Disposed on inner side 46 are guides 42, with which the rotary pistons (not represented) are guided into the rotary piston pump during positioning and synchronization. Guides 42 are provided with protrusions 48 in the lower region close to base body 41 of template 40. Furthermore, a plurality of spacers 44 are positioned on inner side 46 of template 40. A spacing of template 40 from the rotary pistons is ensured by spacers 44 and protrusions 48 during positioning and synchronization of the rotary pistons in the rotary piston pump. This spacing is required to compensate for the thickness of the lining of the pump lid.

Figure 6:
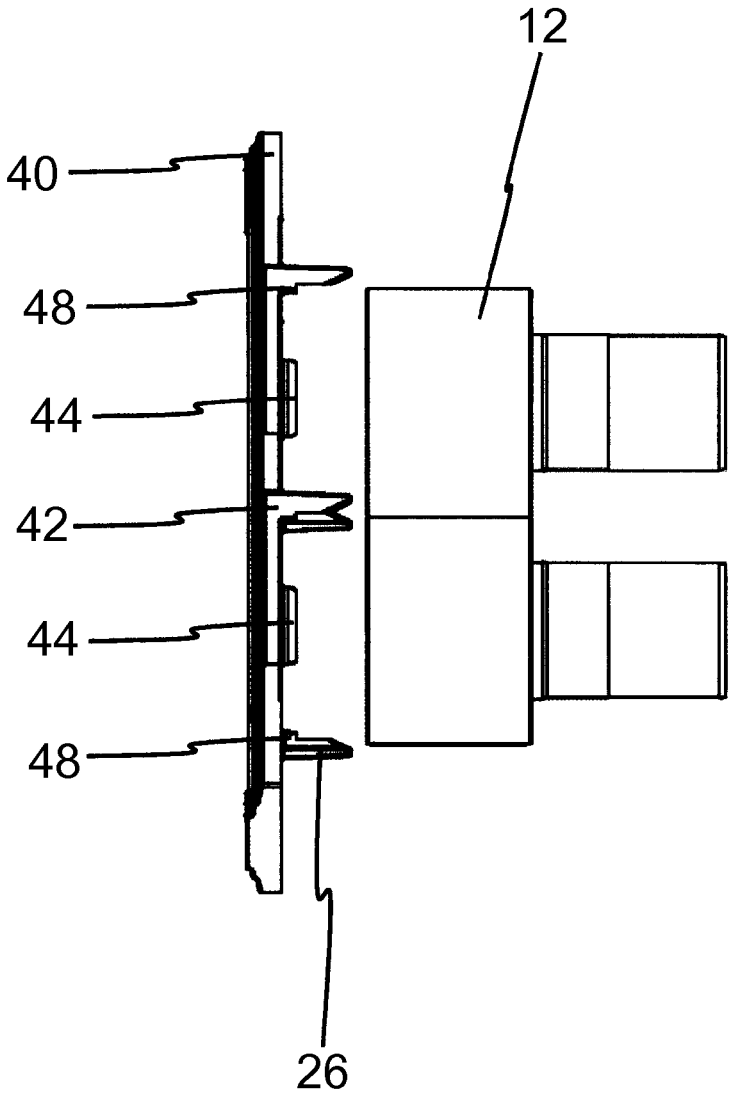
FIG. 6 shows a template according to the invention with a rotary piston.

FIG. 6 shows a template 40 according to the invention with rotary pistons 12. During positioning and synchronization of rotary pistons 12 in a rotary piston pump (not represented), the latter are guided and synchronized by guides 42. The required spacing that rotary pistons 12 must have from template 40 during the positioning and synchronization is ensured by the height/thickness of spacers 20 and protrusions 48.

Figure 7:
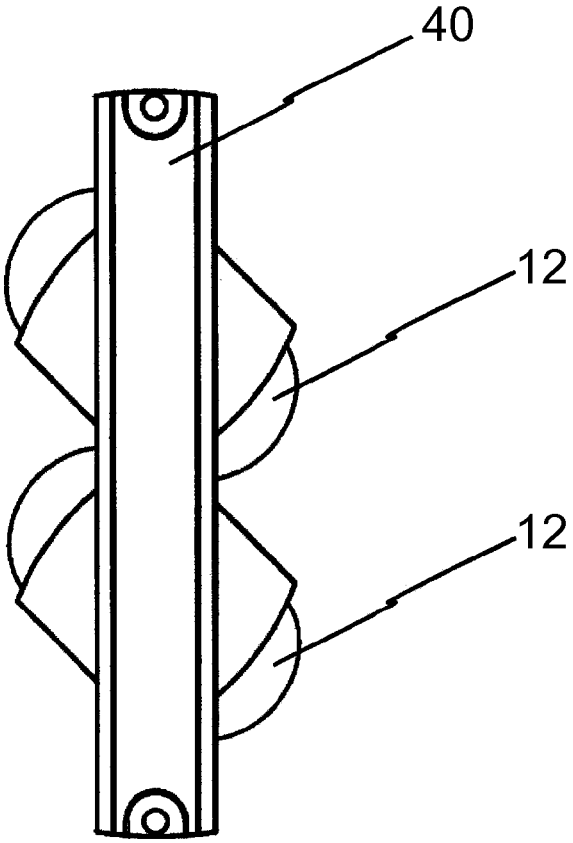
FIG. 7 shows the interaction of the template with the rotary piston.

FIG. 7 shows the interaction of template 40 with rotary pistons 12. Rotary pistons 12 are introduced into template 40 and are guided and synchronized by the guides (not represented). The position of rotary persons 12 with respect to one another can be seen particularly well, which reveals good synchronization for the embodiment shown. The position and alignment of rotary pistons 12 in the rotary piston pump is not changed again subsequently, after the removal of template 40.

Figure 8:
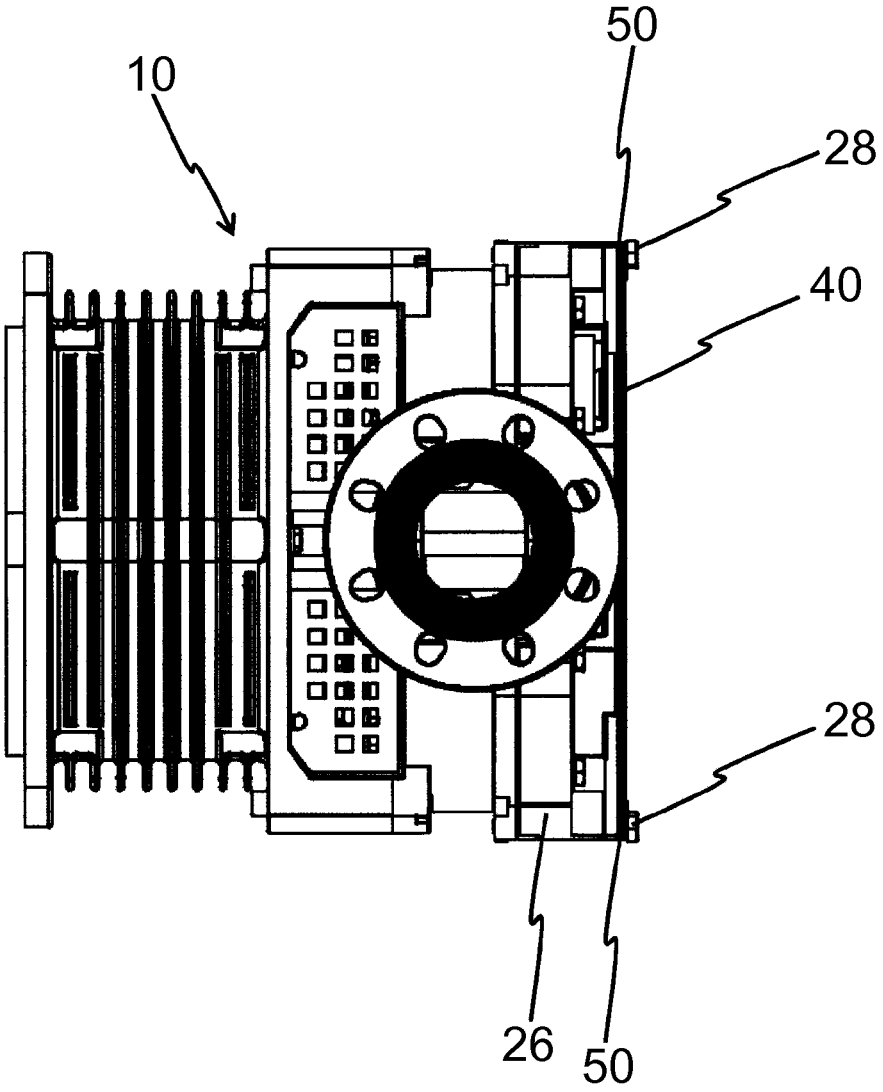
FIGS. 8 and 9 show the position of the template when not in use on a rotary piston pump.
Figure 9:
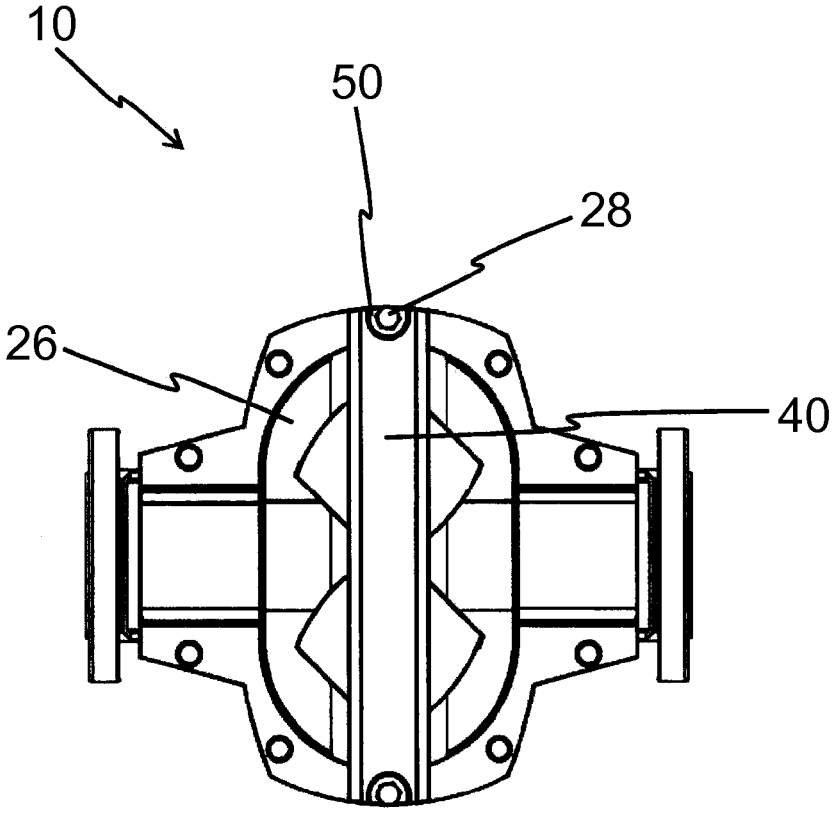

FIGS. 8 and 9 show the position of template 40 when not in use on a rotary piston pump 10. When template 40 is not being used for the positioning and synchronization of the rotary pistons (not represented), the latter can be fixed and positioned in a space-saving manner and securely on the outer side of rotary piston pump 10. Template 40 is fixed to pump lid 26 of rotary piston pump 10 by means of lugs 50. Template 40 is fixed to rotary piston pump 10 by means of screws 28. This manner of retention ensures that the correct template 40 is always present when rotary pistons have to be positioned and synchronized in rotary piston pump 10.

The invention has been described by reference to a preferred embodiment.

LIST OF REFERENCE NUMBERS

10 Rotary piston pump
11 Pump housing
12 Rotary piston
14 Pump space
16 Shaft stub
17 Outer end
18 Pump rear wall
20 Driveshaft
22 Clamping device
23 Sleeve
24 Seal
26 Pump lid
28 Screw
30 Clamping screw
32 Cutout
34 Outer side of clamping device
36 Inner side of clamping device
40 Template
41 Base body
42 Guides

44 Spacer
46 Inner side of template
47 Outer side of template
48 Protrusions of guides
50 Lugs

What is claimed is:

1. A method for fixing and synchronizing rotary pistons in a rotary piston pump, comprising:

introducing the rotary pistons into a pump space of the rotary piston pump;

pushing a shaft stub of each of the rotary pistons through a pump rear wall and onto a respective driveshaft provided for the respective rotary piston;

aligning and synchronizing the rotary pistons with a template, the template including a plurality of guides configured to engage the rotary pistons to position each rotary piston at a selected angular orientation, the template being fixed detachably to a pump housing; and after the synchronizing step, connecting the shaft stubs of the respective rotary piston, in each case using a clamping device in a friction-locked manner, to the respective driveshaft outside the pump space.

2. The method according to claim 1, further comprising: before the introducing step, detachably pushing and fixing seals onto the shaft stubs of the rotary pistons.

3. The method according to claim 1, further comprising: placing the template on the rotary pistons using the plurality of guides.

4. The method according to claim 1, further comprising: simulating a spacing that is required for a lining, and for a pump lid after installation of the rotary pistons, by at least two spacers on a inner side of the template and by protrusions on the plurality of guides.

5. The method according to claim 2, further comprising: adjusting a spacing between the rotary pistons and the pump rear wall using the seals.

6. The method according to claim 4, further comprising: when the template is detached from the pump housing, fixing the template to the pump lid by at least two lugs which are disposed on a base body of the template.

* * * * *